United States Patent [19]

Nason et al.

[11] 4,436,243

[45] Mar. 13, 1984

[54] STORAGE FILE FOR SLIDES AND TISSUE BLOCKS

[75] Inventors: Frederic L. Nason, Van Nuys; Walton B. Crane, Sherman Oaks, both of Calif.

[73] Assignee: Medical Packaging Corporation, Santa Monica, Calif.

[21] Appl. No.: 424,028

[22] Filed: Sep. 27, 1982

[51] Int. Cl.[3] ..... B65D 5/48

[52] U.S. Cl. ..... 229/27; 229/DIG. 11

[58] Field of Search ..... 229/27, 9, 10, 15, DIG. 11

[56] References Cited

U.S. PATENT DOCUMENTS

| | | | |
|---|---|---|---|
| 2,124,808 | 7/1938 | White | 229/27 |
| 2,314,491 | 3/1943 | Greenberg | 229/27 |
| 3,482,734 | 12/1969 | Mierson | 229/27 |
| 3,627,116 | 12/1971 | Cooper | 229/27 |
| 3,713,579 | 1/1973 | Chaffers | 229/DIG. 11 |
| 3,946,870 | 3/1976 | Gajer | 229/9 |
| 4,013,798 | 3/1977 | Goltsos | 229/9 |

*Primary Examiner*—Herbert F. Ross
*Attorney, Agent, or Firm*—Pastoriza & Kelly

[57] ABSTRACT

The storage file is of the temporary type, made up of a box stamping comprising initially a flat sheet such as cardboard provided with appropriate fold lines. The fold lines define a top, left and right sides, a bottom and front and rear ends for folding these components into a box shape. A tray receivable in the box is also formed from a stamping initially starting with a flat sheet which again may be cardboard and having fold lines to define a floor and left and right sides and front and rear ends for the tray. These components again are folded into the tray structure. The tray may optionally be provided with a divider element again formed from a flat sheet appropriately folded to be received in the tray. The storage box is ideally suited for slides and tissue blocks used in medical work. The initial flat configuration of the sheets for making up the box permits compact storage and easy shipment as well as economical manufacture.

3 Claims, 13 Drawing Figures

STORAGE FILE FOR SLIDES AND TISSUE BLOCKS

FIELD OF THE INVENTION

This invention relates generally to packaging products and more particularly to a box and tray structure capable of being manually assembled from flat sheets.

BACKGROUND OF THE INVENTION

Appropriate file boxes for storing slides and tissue blocks and similar medical information and records are known in the art. These files are generally tailored in dimensions for particular components to be stored and may comprise metal or plastic. The file boxes themselves are thus relatively expensive.

There is a need in the medical field for an inexpensive temporary type storage file box for slides and tissue blocks. Ideally, such a file storage should be capable of being made up manually by inexperienced personnel from flat sheet stampings. These flat sheet stampings themselves may constitute cardboard or equivalent inexpensive material and in their formation can be provided with fold lines to facilitate the forming of the desired file box and appropriate trays and the like.

An advantage of the foregoing arrangement is that the flat sheets in their initial stage can be compactly stored and shipped. Moreover, the entire formation of the sheets, once appropriate stamping dies are made, is relatively inexpensive.

BRIEF DESCRIPTION OF THE PRESENT INVENTION

With the foregoing considerations in mind, the present invention contemplates a unique storage file for slides and tissue blocks capable of being made from a box stamping and one or more tray stampings, depending on the number of trays to be received in the box. In the preferred embodiment, a central partition is provided for the box so that specific slides and tissue blocks can be properly supported as files.

The box stamping comprises initially a flat sheet having fold lines defining a top, left and right sides, a bottom and front and rear ends for manual folding into a box. The tray stamping similarly comprises initially a flat sheet having fold lines defining a floor, left and right sides, and front and rear ends for manual folding into a tray structure. The tray structure is receivable in the box. The central partition for the box may constitute an extended portion of the box stamping or a separate means with fold lines receivable in the box.

Since all components of the file for slides and tissue blocks in accord with this invention initially are in the form of flat sheets, compact storage and shipment is readily realized.

BRIEF DESCRIPTION OF THE DRAWINGS

A better understanding of this invention will be had by now referring to the accompanying drawings in which.

DETAILED DESCRIPTION OF THE PREFERRED EMBODIMENT

Figure 1:
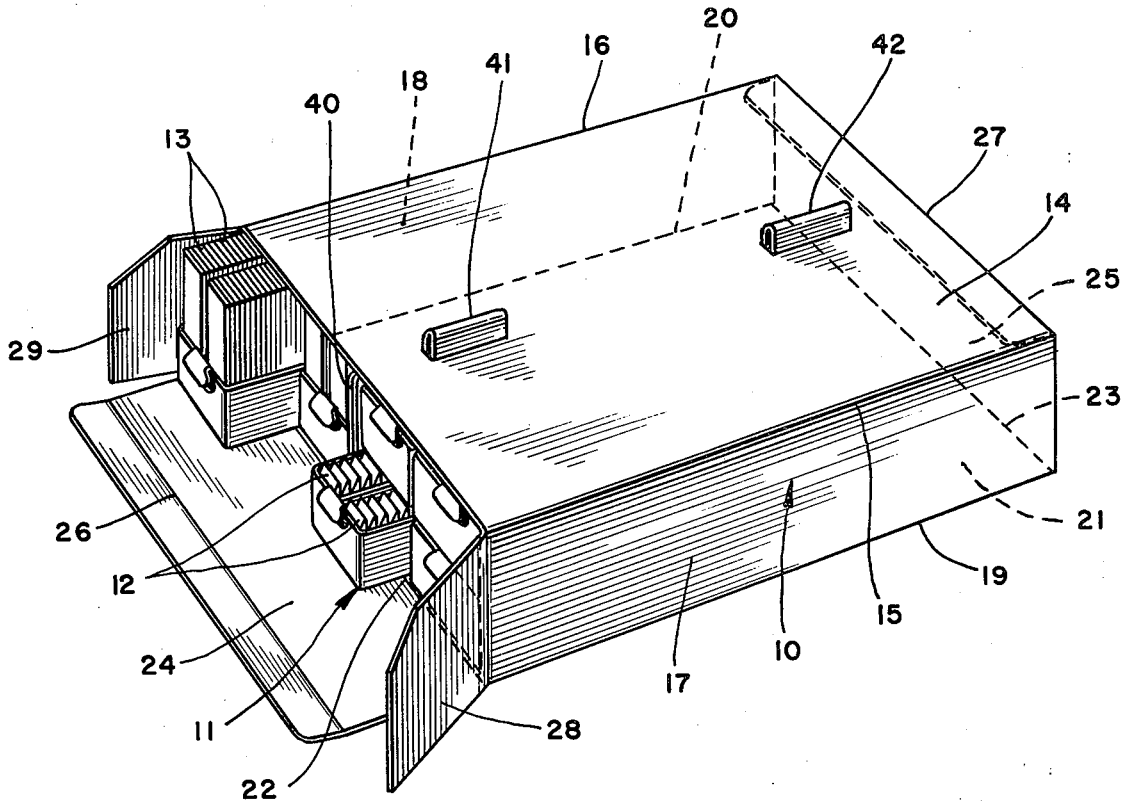
FIG. 1 is a perspective view of a completed storage file for slides and tissue blocks made in accord with the present invention.

Referring first to FIG. 1, the storage file box portion of the invention is indicated generally by the numeral 10. One of the typical trays utilized with the file box 10 is indicated generally by the numeral 11. This tray includes a divider 12 as shown.

The dimension of the file box 10 is such that two tissue block trays may be vertically positioned, one above the other as shown in the left portion of the box in FIG. 1. In the case of tissue slides the upper tray can be removed and only a lower tray used with the tissue slides themselves extending upwardly such as indicated at 13.

The box 10, tray 11 and divider 12 are each formed from a stamped flat sheet provided with appropriate fold lines, all as will be described subsequently. It will be understood, accordingly, that it is only necessary to provide three different flat sheet stampings for the box, tray and divider, repeated use of the specific stampings enabling several boxes with an appropriate desired number of trays and an appropriate desired number of dividers to be economically manufactured.

Considering first the box stamping 10, as shown in FIG. 1, the same includes a top 14 defined between left and right fold lines 15 and 16 constituting the upper left and right edges of the top.

Left and right sides 17 and 18 are in turn defined between the fold lines 15 and 16 and 19 and 20, the latter fold lines corresponding with the lower left and right edges of the left and right sides 17 and 18. The bottom of the box indicated at 21 is defined between the fold lines 19 and 20 and lower front and lower rear fold lines 22 and 23. The bottom 21 further includes forward and rearward extending portions defining front and rear ends 24 and 25. Further fold lines 26 and 27 define end lips which can be tucked under the top edge of the top 14 so that the front and rear ends are frictionally retained in closed position when the box is to be completely closed.

Also shown in FIG. 1 are front flaps 28 and 29 which are folded inwardly prior to upward folding of the front end 24.

Figure 2:
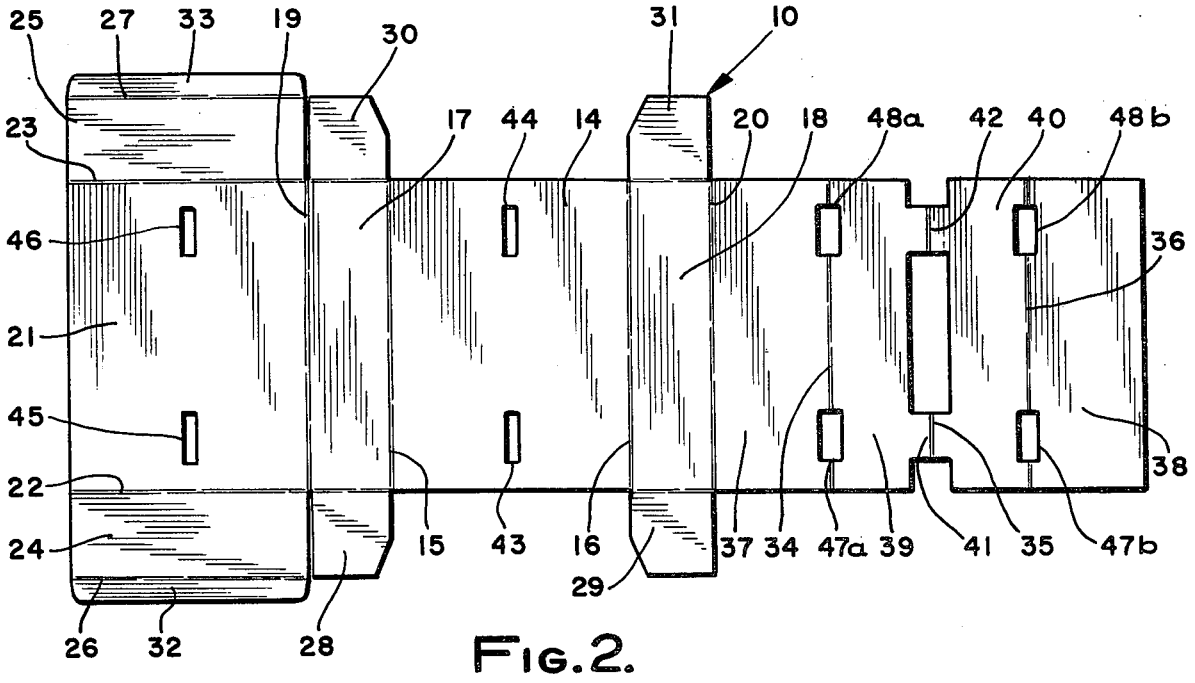
FIG. 2 is a plan view of an initial stamping for the box portion of FIG. 1.

Much of the foregoing will become clearer as well as further features of the box by now referring to the initial flat sheet layout shown in plan view in FIG. 2.

More particularly, in FIG. 2 the same numerals are employed to designate the corresponding portions as are used in FIG. 1. Thus, the top 14 is shown in the central portion defined between the left and right fold lines 15 and 16. The left and right sides 17 and 18 similarly are defined between the aforementioned fold lines and the outer fold lines 19 and 20. The bottom portion is shown at 21 between fold lines 22 and 23 and the front and rear ends 24 and 25 are shown between the previously entioned fold lines and the outer fold lines 26 and 27.

The flaps 28 and 29 described in FIG. 1 are shown in the lower portion of FIG. 2. Similar rear flaps are shown at 30 and 31, these flaps being foldable inwardly as will become apparent as the description proceeds. The referred to lips on the front and rear ends 24 and 25 are shown to the left in FIG. 2 at 32 and 33.

In accordance with an important feature of this invention, the box stamping described further includes an extended portion as seen on the right side of FIG. 2 having fold lines 34, 35 and 36 defining a partition for the interior of the box. Partition support portions are indicated at 37 and 38, the partition itself being formed by portions 39 and 40 when folded about the fold line 35. In this latter respect, folding of the portions 39 and 40 about the fold line 35, the portions 39 and 40 being urged downwardly out of the plane of the drawing, results in the formation of tabs 41 and 42 along this fold line. These tabs 41 and 42 are arranged to protrude through slots 43 and 44 in the top 14 in assemblying the box. The protrusion of these tabs 41 and 42 is clear in FIG. 1.

Referring once again to FIG. 2 the flat sheet stamping is completed by the provision of further slots 45 and 46 in the bottom 21 arranged to register with slot pairs 47*a*, 47*b* and 48*a*, 48*b* on fold lines 34 and 36 on either side of the partition portions 39 and 40. The purpose for these slots will also become clearer as the description proceeds.

Referring now to FIGS. 3 through 6, the various manual steps performed in forming the box 10 of FIG. 1 from the flat sheet layout of FIG. 2 will become evident.

Figure 3:
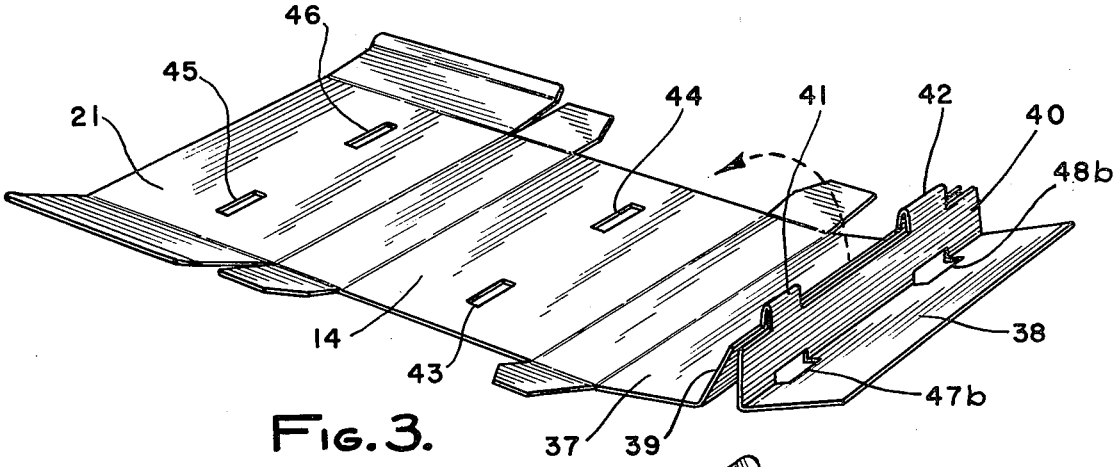
FIGS. 3, 4, 5 and 6 are perspective views showing successive manual steps in forming the box structure from the stamping of FIG. 2.

Referring first to FIG. 3, the extended portion defining the partition and partition support portions 37 and 38 is first manipulated to produce the tabs 41 and 42. This action of folding the partition portions 39 and 40 together also causes the slots 47*a* and 47*b* and 48*a* and 48*b* shown in FIG. 2 to merge together.

Figure 4:
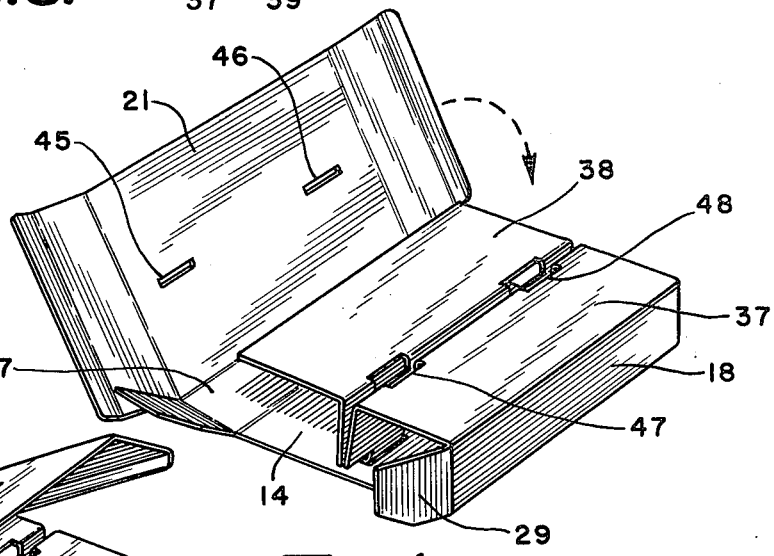

In FIG. 4 it will be noted that the partition part has been turned over so that the tabs 41 and 42 will be received through the slots 43 and 44 in the top 14.

Figure 5:
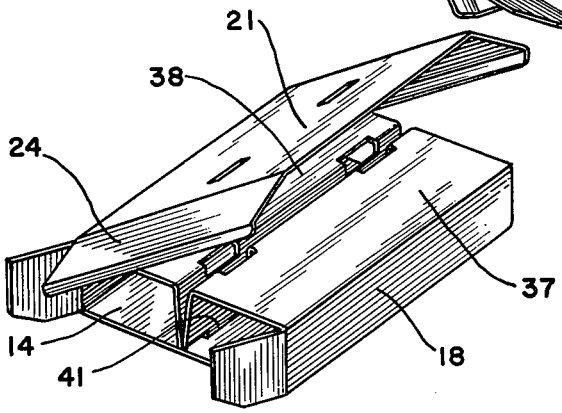

Next, the bottom 21 and left side 17 are folded upwardly and over the partition portions 37 and 38 as shown in FIG. 5.

Figure 6:
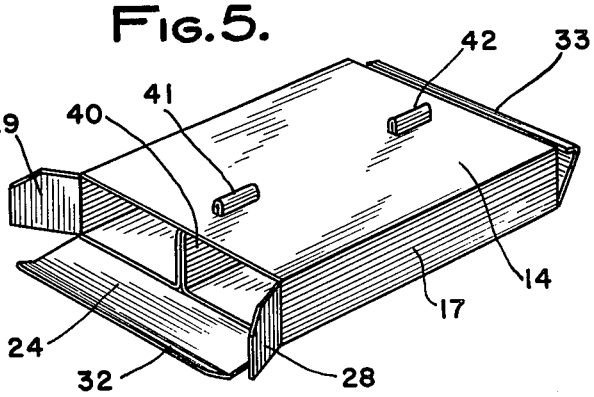

After this last step depicted in FIG. 5, the entire box is turned over so that the bottom 21 is facing downwardly as shown in FIG. 6, the protruding tabs 41 and 42 then being positioned upwardly through the top 14.

With the box in the position illustrated in FIG. 6, the rear flaps 30 and 31 shown in FIG. 2 are folded inwardly and the rear end and lip 33 tucked under the top 14 as described heretofore to close the rear of the box. The front of the box can remain open preparatory to receiving further components of the file assembly to be ultimately described.

Figure 7:
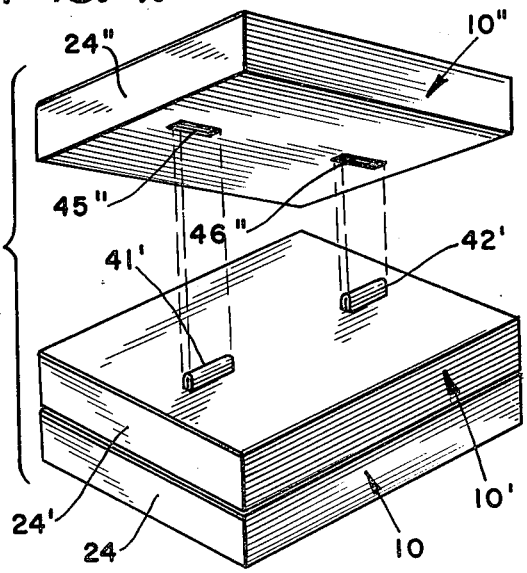
FIG. 7 is an exploded perspective view showing the manner in which several boxes can be indexed in a vertical stacked relationship.

The significance of the tabs 41 and 42 will now be evident by referring to FIG. 7 wherein these tabs protrude through the top 14 a sufficient distance as to be capable of indexing into bottom slots corresponding to the slots 45 and 46 which now register with the slot pairs depicted at 47 and 48 in the partition of FIG. 4. This arrangement permits indexing of a vertical stack of boxes as shown in FIG. 7. Thus, there is shown the first box 10 described in FIGS. 3 through 6 completely folded into a closed position. On top of the box 10 is another box 10′ identical in construction, with its tabs indicated at 41′ and 42′ protruding through its top. A third box 10″ is shown in perspective with its bottom slots 45″ and 46″ arranged to receive the protruding tabs 41′ and 42′ on the box 10′, when vertically stacked thereon.

From the foregoing, it will thus be seen that the tabs 41 and 42 not only serve to stabilize the partition 40 within the interior of the box as shown in FIG. 6 but also serve as indexing tabs and with the partition, as a column support for stacked boxes.

Figure 8:
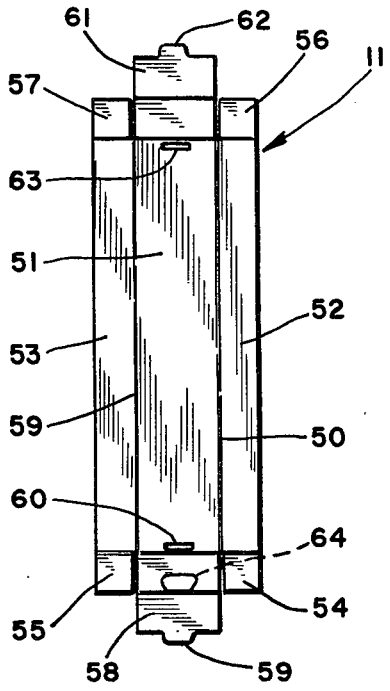
FIG. 8 is a plan view of an initial stamping for one of the trays receivable in the box of FIG. 1.

Referring now to FIG. 8, there is shown a flat sheet layout for forming a typical one of the trays such as the tray 11 described in FIG. 1. This flat sheet stamping includes fold lines 49 and 50 defining therebetween a tray floor 51 and left and right tray sides 52 and 53. The extending ends of these sides define front flaps 54 and 55 and rear flaps 56 and 57. A front closure for the tray is shown at 58 provided with a tab 59 arranged to be received in a slot 60 in the assembly of the tray. Similarly, a rear end closure 61 provided with a tab 62 arranged t be received within the slot 63 closes off the rear.

Figure 9:
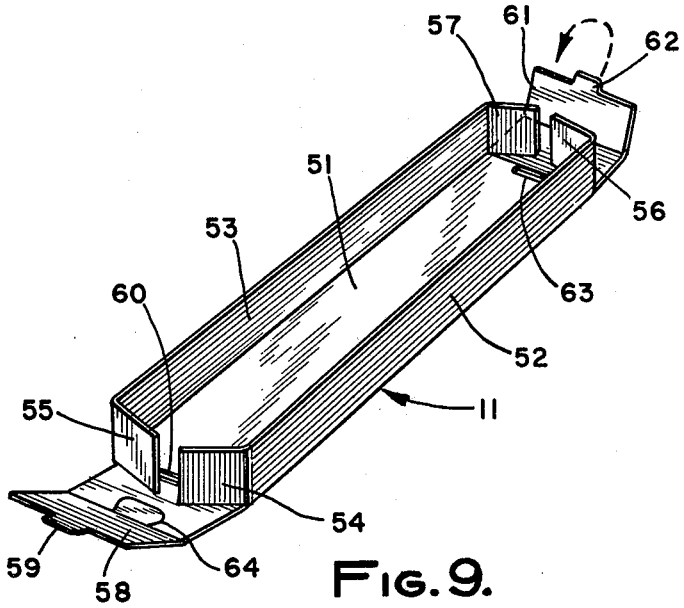
FIGS. 9 and 10 are perspective views illustrating manual steps in forming the tray from the stamping of FIG. 8.
Figure 10:
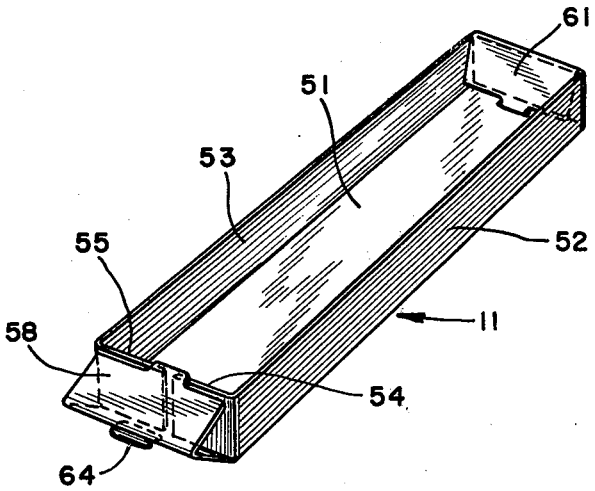

The foregoing formation of the tray can best be seen by referring to FIGS. 9 and 10, wherein it will be noted that the left and right sides 52 and 53 are folded upwardly and thence the front and rear flaps 54, 55 and 56 and 57 folded inwardly. Thereafter, the front end 58 and rear end 61 are folded upwardly and over the tops of the inwardly turned flaps so that the front and rear end tabs 59 and 62 can be received in the slots 60 and 63 respectively. Enc 58 further includes a pull tab 64 as shown.

Figure 11:
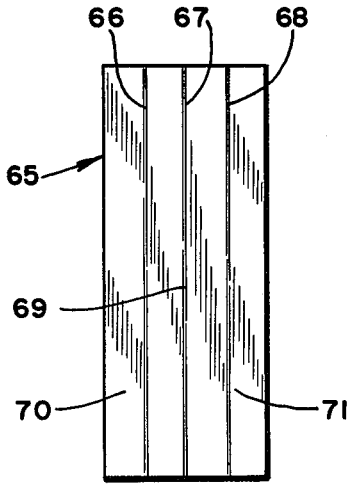
FIG. 11 is a plan view of an initial flat sheet for forming a divider for the tray of FIG. 10.
Figure 12:
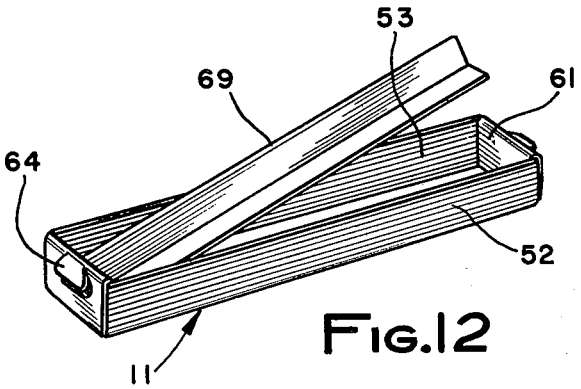
FIG. 12 illustrates in perspective view a manual step of inserting the divider of FIG. 11 into a tray; and, FIG. 13 is a transverse cross section of the divider and tray of FIG. 12 in assembled relationship.

Referring now to FIG. 11, there is shown a third flat sheet stamping which is optional but is useful to provide a divider for the tray described in FIGS. 8, 9 and 10. This divider comprises a rectangular sheet 65 having fold lines 66, 67 and 68. By folding the sheet 65 about the center fold line 67 so that the center fold line projects upwardly, a resilient divider portion 69 is defined. Appropriate lateral flaps 70 and 71 in turn extend outwardly from the fold lines 66 and 68 to be received on the floor of the tray as shown in FIG. 12.

Figure 13:
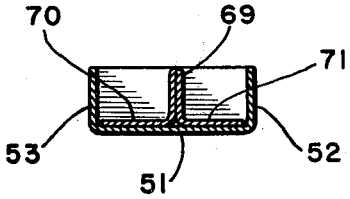

In FIG. 13, the lateral flaps 70 and 71 are shown engaging the floor 51 of the tray to hold the divider portion 69 in a position to extend along the center of the tray. These flaps can be made to terminate short of the left and right sides of the tray so that the inverted folded V - shaped portion 69 can expand and contract to accommodate the widths of slides or blocks held in the tray on either side of the divider. In this respect, the divider is referred to herein as resilient.

Referring once again to FIG. 1, it will now be appreciated that the box 10 with its central partition 40 and cooperating trays 11 with their dividers 12 will result in a very economical and useful storage file for slides and tissue blocks. The necessity of only providing three different initial stampings in the form of flat sheets provides for economical manufacture and compact storage and shipping for the files. However, it whould be understood that the central partition 40 for the box could be a separate stamping and simply slid into the box with the tabs 41 and 42 positioned in the slots 43 and 44. Also this partition 40 can be folded down to provide a full volume in the box for use as a shipping containine for the other components. In assemblying the box, the partition is simply raised up to convert the box to a filing box for the trays as described.

We claim:

1. A storage file for slides and tissue blocks including, in combination:

(a) a box stamping comprising initially a flat sheet having fold lines defining a top, left and right sides, a bottom and front and rear ends for folding into a box;

(b) means having fold lines defining a central partition in said box including an extended portion of said box stamping, said extended portion when folded to form the partition defining front and rear tabs, the central area of the top having front and rear slots for receiving said tabs, and the central area of said bottom having front and rear slots for receiving the protruding tabs from the top of another box to enable indexing of several of the boxes in a vertical stack; and (c) a tray stamping comprising initially a flat sheet having fold lines defining a floor, left and right sides, and front and rear ends for folding into a tray receivable in said box whereby a storage file for slides and tissue blocks can be economically formed from said box, partition and tray stampings, and whereby said stampings in their initial flat configuration can be compactly stored and shipped.

2. A storage file according to claim 1, further including a tray divider stamping comprising initially a flat sheet having fold lines to form into a generally vertical resilient divider with lateral flaps receivable on the floor of said tray so that the vertical divider extends along the center of the tray.

3. A storage file according to claim 1, in which said fold lines also define front flaps extending from the fronts of said left and right sides and rear flaps extending from the rear of said left and right sides for inward folding to cover the front and rear openings of the box prior to folding said front and rear ends and wherein there are defined front and rear lips extending from the front and rear ends for tucking over the edges of said flaps and under the front and rear edges of said top so that the front and rear ends are frictionally retained in closed position by said lips.

* * * * *